United States Patent [19]

Roswell

[11] 4,189,800

[45] Feb. 26, 1980

[54] SELF-CONTAINED BREADBOARD WIRING TOOL

[75] Inventor: Terry E. Roswell, Hudson, Wis.

[73] Assignee: Minnesota Mining and Manufacturing Company, St. Paul, Minn.

[21] Appl. No.: 958,269

[22] Filed: Nov. 6, 1978

[51] Int. Cl.[2] ..... B25B 25/00; H01R 43/00

[52] U.S. Cl. ..... 7/107; 7/158; 29/566.4; 29/751

[58] Field of Search ..... 29/566.4, 566.2, 566, 29/33 M, 750, 751, 758; 7/107, 158

[56] References Cited

U.S. PATENT DOCUMENTS 3,168,750 2/1965 Gattiker, Jr. ..... 7/107

*Primary Examiner*—Gil Weidenfeld

*Attorney, Agent, or Firm*—Cruzan Alexander; Donald M. Sell; Terryl K. Qualey

[57] ABSTRACT

Apparatus for inserting thin insulated wire into narrow slots of solderless electrical contacts and subsequently cutting the length of wire needed. The cutting tool is a prolongation of the shaft supporting a supply spool of the requisite wire.

1 Claim, 7 Drawing Figures

SELF-CONTAINED BREADBOARD WIRING TOOL

This invention relates to a pen-like apparatus for inserting thin insulated wires into slotted solderless electrical contacts and running the wire to other such contacts. This invention further relates to a pen-like apparatus including cutting means for severing the wire after the desired connections have been made.

Heretofore many solderless electrical connections have been made by removing insulation from a small portion of the end of the wire and then winding the bare wire around the terminal manually or mechanically. An improved solderless electrical connection is described by Cherney and Dodsworth, U.S. Pat. No. 4,012,102, and in Bittner and Dodsworth, U.S. Pat. No. 4,099,816, in which the wire is forced into an open ended slot without removal of insulation relying on the edges of the slot to cut through the insulation and establish good electrical connection. Although wires are readily connected in this fashion manually, a tool to assist in insertion is desirable particularly when a tough polyvinylidene fluoride insulation on the wire is to be penetrated.

U.S. Pat. Nos. 3,708,852 and 3,898,724 are illustrative of prior devices for insertion of wires in slots. Each includes hammer means to assist in the operation of the device.

The present invention provides a tool for inserting thin wires into the narrow slots of solderless electrical connectors which tool includes a spool of wire, a tip for forcing the wire into the slot and manually operated cut off for severing the wire as desired. More particularly the invention provides a breadboard wiring tool comprising a shaft having a longitudinal axis and threaded at one end, cutting means at the end of said shaft distal to said threaded end and displaced laterally from the axis thereof, an elongated supply spool of insulated wire on said shaft, cylindrical retaining means screwed to the threaded end of said shaft, spring means urging said supply spool away from said retaining means, a hollow head movably penetrated by and with retaining means for holding said cutting means in and protruding from said head, a tip with shallow and deeper slots therein on said head offset from the center thereof and with said shallow slot radially aligned on said head, guide means conducting insulated wire from said supply spool toward said shallow slot and cylindrical casing enclosing said shaft and supply spool secured to said head and extending over at least a portion but not all of said cylindrical retaining means.

The invention is more fully described by reference to the drawings wherein

Figure 1:
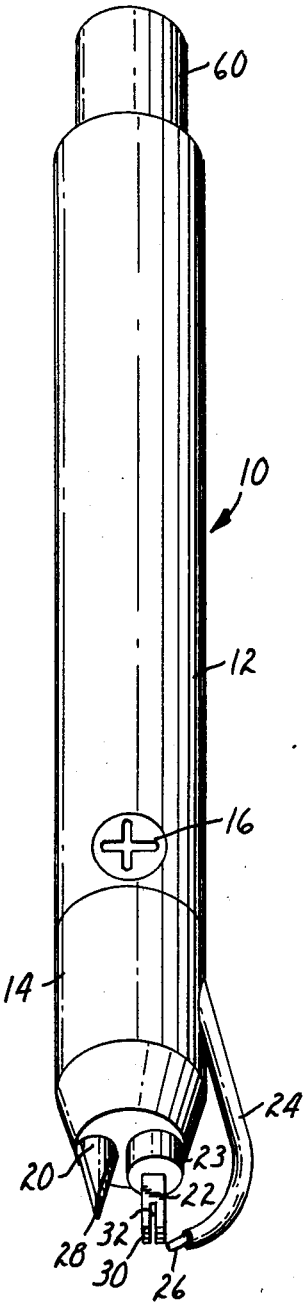
FIG. 1 is a perspective view of a wiring tool of the invention.
Figure 2:
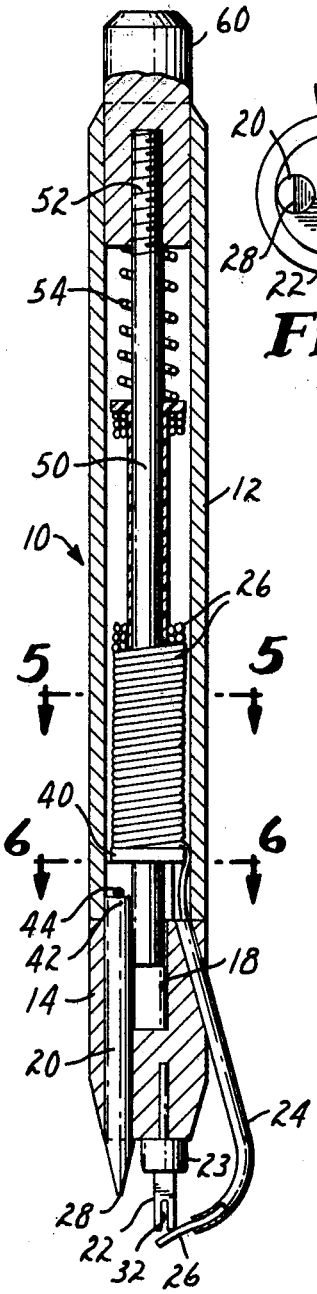
FIG. 2 shows a wiring tool of the invention with parts of the casing broken away to show internal structure.
Figure 4:
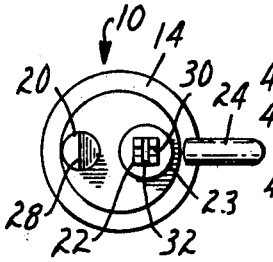
FIG. 4 is a view of the end of a wiring tool of the invention.

A wiring tool according to the invention (10) will be seen to comprise cylindrical casing (12) attached to head (14) by screw (16). Head (14) externally shows cutting tool (20) with cutting edge (28), tip (22) with cutter (23) and tube (24) for delivery of wire (26) to tip (22). Tip (22) is provided with shallow slot (30) and deeper slot (32). It is contemplated that tips having variable slot depths may be interchanged for one with various slotted connectors. It will be seen that wire (26) is contained within wiring tool (10) on spool (40) shown partially broken away in FIG. 2 to expose shaft (50) which is prolonged to threaded portion (52) and toward head (14) where it joins (or may be offset to) cutting tool (20) in hollow portion (18) of head (14). It will be noted that the knee (42) where cutting tool (20) joins shaft (50) rests against stop (44) which is detachable from head (14). It will be seen further that retainer (60) on shaft (50) prevents loss of spring (54) which urges spool (40) against stop (44).

Figure 3:
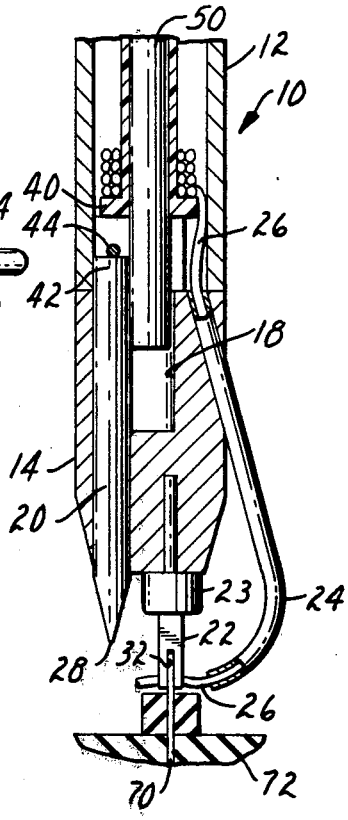
FIG. 3 is an enlarged view showing how a wiring tool of the invention engages an electrical connector.
Figure 5:
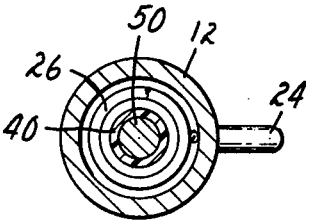
FIGS. 5 and 6 show sectional views of a wiring tool of the invention taken at 5—5 and 6—6 respectively of FIG. 2.
Figure 6:
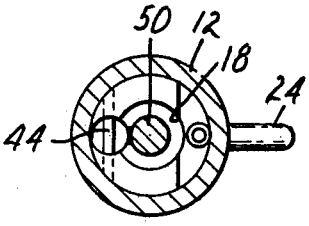
Figure 7:
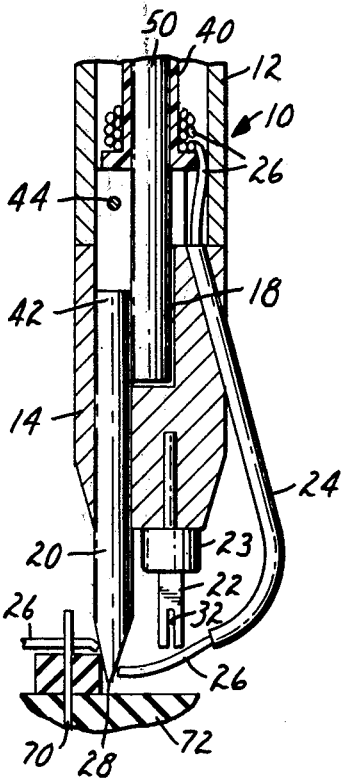
FIG. 7 is an enlarged view showing how a wiring tool of the invention is employed to sever the wire after connection has been made as shown in FIG. 3.

Referring to FIG. 3 in which cutting tool (20) is retracted it will be seen how the tool is employed by applying the long slot (32) of tip (22) over slotted connector (70) set in base (72) while wire (26) with insulation intact rests in shallow slot (30) not shown in this view. Subsequently cutting tool (20) is extended by pressing on retainer (60) and used to cut wire (26) (FIG. 7).

What is claimed is:

1. Breadboard wiring tool comprising:

(1) a shaft having a longitudinal axis and threaded at one end;

(2) cutting means at the end of said shaft distal to said threaded end and displaced laterally from the axis thereof;

(3) an elongated supply spool of insulated wire on said shaft;

(4) cylindrical retaining means screwed to the threaded end of said shaft;

(5) spring means urging said supply spool away from said retaining means;

(6) a hollow head movably penetrated by said shaft and with retaining means for holding said cutting means in and protruding from said head and stop means for preventing entrance of said spool on said shaft into said head;

(7) a tip with shallow and deeper slots therein on said head offset from the center thereof and with said shallow slot radially aligned on said head;

(8) guide means conducting insulated wire from said supply spool toward said shallow slot; and (9) cylindrical casing enclosing said shaft and supply spool secured to said head and extending over at least a portion but not all of said cylindrical retaining means.

* * * * *